United States Patent [19]

Conemac

[11] Patent Number: 4,888,578

[45] Date of Patent: Dec. 19, 1989

[54] WIRELESS ELECTRONIC ALARM FOR INSTALLATION IN SLIDING DOOR OR WINDOW CASINGS

[76] Inventor: Timothy D. Conemac, 11315 Montgomery Ave., Granada Hills, Calif. 91344

[21] Appl. No.: 228,140

[22] Filed: Aug. 4, 1988

Related U.S. Application Data

[63] Continuation-in-part of Ser. No. 125,165, Nov. 25, 1987, abandoned.

[51] Int. Cl.[4] ..... G08B 13/08; H01H 3/16

[52] U.S. Cl. ..... 340/546; 200/61.73

[58] Field of Search ..... 340/545, 546; 200/61.71, 61.73–61.75, 61.93, 43.04, 43.07

[56] References Cited

U.S. PATENT DOCUMENTS

| | | | |
|---|---|---|---|
| 2,870,281 | 1/1959 | Mitchell | 340/546 X |
| 3,797,005 | 3/1974 | Schwarz | 340/545 X |
| 4,143,367 | 3/1979 | Schestag | 340/545 X |
| 4,193,067 | 3/1980 | Hawkins | 340/546 |
| 4,266,216 | 5/1981 | Trusty | 340/546 |
| 4,442,427 | 4/1984 | Morton | 340/546 |
| 4,495,486 | 1/1985 | White | 340/546 |
| 4,534,194 | 8/1985 | Aydin | 70/278 |
| 4,538,142 | 8/1985 | Hamilton et al. | 340/667 |
| 4,540,980 | 9/1985 | Porco | 340/546 X |
| 4,553,134 | 11/1985 | Holt | 340/545 |
| 4,607,253 | 8/1986 | Wooten et al. | 340/546 |

*Primary Examiner*—Joseph A. Orsino
*Assistant Examiner*—Thomas J. Mullen, Jr.
*Attorney, Agent, or Firm*—John J. Posta, Jr.

[57] ABSTRACT

A device for use as an alarm for detecting the unauthorized opening of a sliding door or window is disclosed which is a wireless electronic alarm device which may be easily installed either horizontally or vertically in the casing of a sliding door or window to resist forced opening of the sliding door or window while simultaneously sounding a highly audible alarm signal indicative of an attempt to break in. The alarm device is of lightweight, portable construction in a tubular design which acts to substantially forestall the opening of the sliding door or window without the application of force sufficient to break the door or window. Once triggered, the alarm will continue until the unobtrusive owner-activated reset switch is activated to disarm the device.

24 Claims, 2 Drawing Sheets

WIRELESS ELECTRONIC ALARM FOR INSTALLATION IN SLIDING DOOR OR WINDOW CASINGS

CONTINUING APPLICATION INFORMATION

This application is a continuation-in-part of Ser. No. 125,165, filed on Nov. 25, 1987, now abandoned.

BACKGROUND OF THE INVENTION

Field of the Invention

The present invention relates generally to an alarm for detecting the unauthorized opening of a sliding door or window, and more particularly to an improved lightweight, portable, wireless electronic alarm device which may be easily installed horizontally or vertically in the casing of a sliding door or window to resist forced opening of the sliding door or window while simultaneously sounding a highly audible alarm signal indicative of an attempt to break in.

One of the consequences of our increasingly crowded urban society has been the inexorably increasing crime rate, the mere threat of which has driven many people to be security-conscious. Breaking and entering and burglary have become increasingly common occurrences, particularly in the case of residential property. Accordingly, the sale and installation of various security systems such as burglar alarms has become a thriving business as many property owners seek to discourage crime to property through the use of such systems.

There are two basic types of security systems: first, the professionally-installed central security system, which is used in privately-owned houses and luxury apartments, and secondly the owner-installable or portable systems of various types which are each installed on a single door or window. The second type of device is particularly used by apartment dwellers, both since the purchase of such systems are more economical, and since they can usually be removed and taken when the owner of the device moves. They also find substantial use in homes of people who do not wish to pay the high price of a central security system.

In most apartments and homes the windows are sliding windows, either opening by sliding the moveable window horizontally or vertically to open or close them. Some apartments and homes have exterior patios with sliding doors, which slide horizontally to open or close. A number of the relatively inexpensive, owner-installable security devices, unfortunately, do not work with such slidable doors and windows. Typical of one type of such systems are those shown in U.S. Pat. No. 2,870,281, to Mitchell, in U.S. Pat. No. 4,442,427, to Morton, and in U.S. Pat. No. 4,607,253, to Wooten, et al. These devices are intended for use with a conventional hinged door which opens inwardly, and act as braces installed with one end under the doorknob and the other end on the floor away from the door. When the door is opened slightly, these devices will inhibit the door from opening and will provide an audible alarm.

The other type of device is illustrated by U.S. Pat. No. 4,540,980, to Porco. The Porco device is illustrative of those devices which are placed in front of an inwardly opening hinged door. When the door is opened, the device will be jarred or tipped over, causing an alarm to be sounded. Other similar devices are designed to be hung from the doorknob, and will react to the door being opened through the use of motion detectors. Unfortunately, neither the devices installed as braces under the doorknobs or the devices which are tipped over or jarred by the door being opened are useable on sliding doors or windows.

Accordingly, it is the primary objective of the present invention to provide an alarm device which is useable on sliding doors and windows. The most popular type of device useable on sliding windows and doors is the bar-type device, which is illustrated in U.S Pat. No. 4,193,067 to Hawkins in U.S. Pat. No. 4,495,486, to White, and in U.S. Pat. No. 4,553,134, to Holt. The Hawkins device has a rod which operates a mechanical switch, with a detent retaining the rod in a position to continuously operate the switch once initially operated. The White alarm acts as a physical obstruction preventing opening of a sliding door or window until it is removed, at which time the alarm will be sounded.

The Holt device is a spring-loaded bar which may be installed in a window casing. The Holt device has a significant disadvantage that it is not widely adaptable to different size window casings. While the spring allows a small degree of adjustment, it is not sufficiently wide to allow the Holt device to be installed in windows of more widely varying widths. It is thus desirable that the alarm device of the present invention be adjustable to fit in a more widely variable group of window or door sizes.

While sliding doors and many sliding windows open and close horizontally, a substantial percentage of sliding windows open and close vertically rather than horizontally. It is accordingly desirable that the present invention provide a design for an alarm which will be universal in its ability to fit into vertically opening and closing windows as well as horizontally closing doors and windows.

It is also an objective of the alarm device of the present invention that it be both simple and easy to install. No tools should be required in the installation, and installing the device should not result in any damage to the door, the window, or the casing in which the door or window is mounted. It is a particular disadvantage of highly visible devices that they are not aesthetically pleasing. As a result, highly visible devices will not be desirable to a large number of prospective buyers even though the visibility may have some effect to discourage intruders. Therefore, the alarm device of the present invention should be unobtrusive when installed so as not to effect a disconcerting presence inside the property.

It is also apparent to those skilled in the art that by making the alarm device of the present invention portable as well as easy to install without requiring tools, it is also made highly desirable for use by travelers in windows in hotel rooms. In addition, of course, it is desirable that the improved alarm device of the present invention be mechanically simple to ensure reliable operation. Therefore, as few moving parts as possible should be utilized, to enhance the reliability of the device. The operation of the device should sound an alarm when a forced entry is attempted. Note that the White device mentioned above does not operate in this manner, but rather sounds an alarm only when removed.

In addition, the improved alarm device of the present invention should also be of solid state construction, to ensure a long, reliable lifetime as well as energy efficient operation. When the alarm is sounded, it should continue until the device is reset, with the resetting operation being simple yet not obvious upon initial inspection. The alarm of the present invention should also be of inexpensive construction, thereby ensuring the broadest possible appeal in the alarm market. Finally, the improved alarm of the present invention should provide all of the aforesaid advantages and objectives without incurring any relative disadvantage.

SUMMARY OF THE INVENTION

The disadvantages and limitations of the background art discussed above are overcome by the present invention. With this invention, a two-piece tubular alarm device is designed to fit in the track of sill of a sliding window or a sliding door. A hollow outer tube fits over an inner tube, with the combined length of the two tubes being adjustable through a detent mechanism. An adjustment button extends from the outer diameter of the inner tube, and the outer tube has a number of adjustment apertures evenly dispersed along the length of the outer tube. By placing the inner tube in the outer tube and locating the detent button in the appropriate adjustment aperture in the outer tube, the device may be adjusted to an appropriate length to fit between the window or door and the casing with the window or door in a closed position.

The inner tube contains therein a solid state alarm circuit, batteries to power the circuit, and a buzzer or other audible electronic alarm mechanism. The inner tube has a plurality of small apertures therein to allow the audible signal generated by the buzzer to be propagated into the surroundings. On the end of the inner tube not inserted into the outer tube two electrical contacts are placed. An activating end cap containing a conductive element therein is placed on the end of the inner tube on which the electrical contacts are located, with the activating end cap not fully inserted onto the end of the inner tube and the conductive element accordingly spaced away from the electrical contacts.

If the device is to be installed in a horizontally opening window or door, it is then placed in the bottom track or sill with the window or door in a closed position. One end of the device will be located against the edge of the window or door which may be moved to open the window or door. The other end of the device will be placed against the window casing in a manner whereby if the window or door is opened, the activating end cap will be forced fully onto the end of the inner tube, bringing the conductive element into contact with the two contacts on the end of the inner tube, setting off the alarm.

Similarly, if the device is to be installed in a vertically opening window, it is then placed in the side track of the window with the window in a closed position. One end of the device will be located against the edge of the window which may be moved to open the window, and the other end of the device will be placed against the window casing in a manner whereby if the window is opened, the activating end cap will be forced fully onto the end of the inner tube. The alarm will thus be actuated in a similar manner.

Once actuated, the alarm will continue even if the activating end cap is removed from the end of the inner tube, removing the conductive element from contact with the electrical contacts. The alarm device may only be turned off by resetting the device. A small, unobtrusive aperture is located in the side of the inner tube, with a reset switch in the inner tube being accessible through the small aperture. By inserting a thin object such as the tip of a pen through the small aperture, the reset switch may be pressed to reset the alarm (assuming the conductive element is no longer in contact with the two electrical contacts on the end of the tube).

It will be appreciated that the alarm device will also act as a bar to movement of the window or door, thus preventing the window or door from being opened. The device thus acts as both a bar to keep the window from being opened by intruders, and as an alarm to indicate that an intruder is attempting to gain entry. The alarm device is collapsible to a relatively short length, and since it is compact and light in weight, it is quite portable. In the preferred embodiment, several different sizes of the device may be manufactured, with varying lengths to fit virtually any door or window from the smallest to the largest used in residential buildings.

It is thereby apparent that the present invention provides an alarm device which is conveniently useable on sliding doors and windows. The device has a bar which acts as a physical obstruction preventing opening of a sliding door or window until the device is removed. In operation, the device sounds an alarm when a forced entry is attempted. When the alarm is sounded, it continues until the device is reset, with the resetting operation being simple yet not obvious upon initial inspection.

The alarm device of the present invention is widely adjustable to fit in windows or doors of considerably varying widths, and it is universal in its ability to fit into vertically opening and closing windows as well as horizontally opening and closing doors and windows. In addition, the alarm device of the present invention is both simple and easy to install. No tools are required to install the alarm device, and installing it does not result in any damage to the door, the window, or the casing in which the door or window is mounted. Since it is unobtrusively installed in the track or sill of a window or door, it is not a highly visible device and as such is not aesthetically displeasing.

The alarm device is collapsible and portable as well as easy to install without tools, and is therefore highly desirable for use by travelers in windows in hotel rooms. The improved alarm device of the present invention is mechanically simple to ensure reliable operation, and has an absolute minimum of moving parts, thereby enhancing the reliability of the device. It is of solid state construction, ensuring a long, reliable lifetime as well as energy efficient operation. The alarm of the present invention is also of inexpensive construction, thereby ensuring the broadest possible appeal in the alarm market. Finally, the improved alarm of the present invention provides all of the aforesaid advantages and objectives without incurring any relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figures 1, 2, 3, 4, 5:
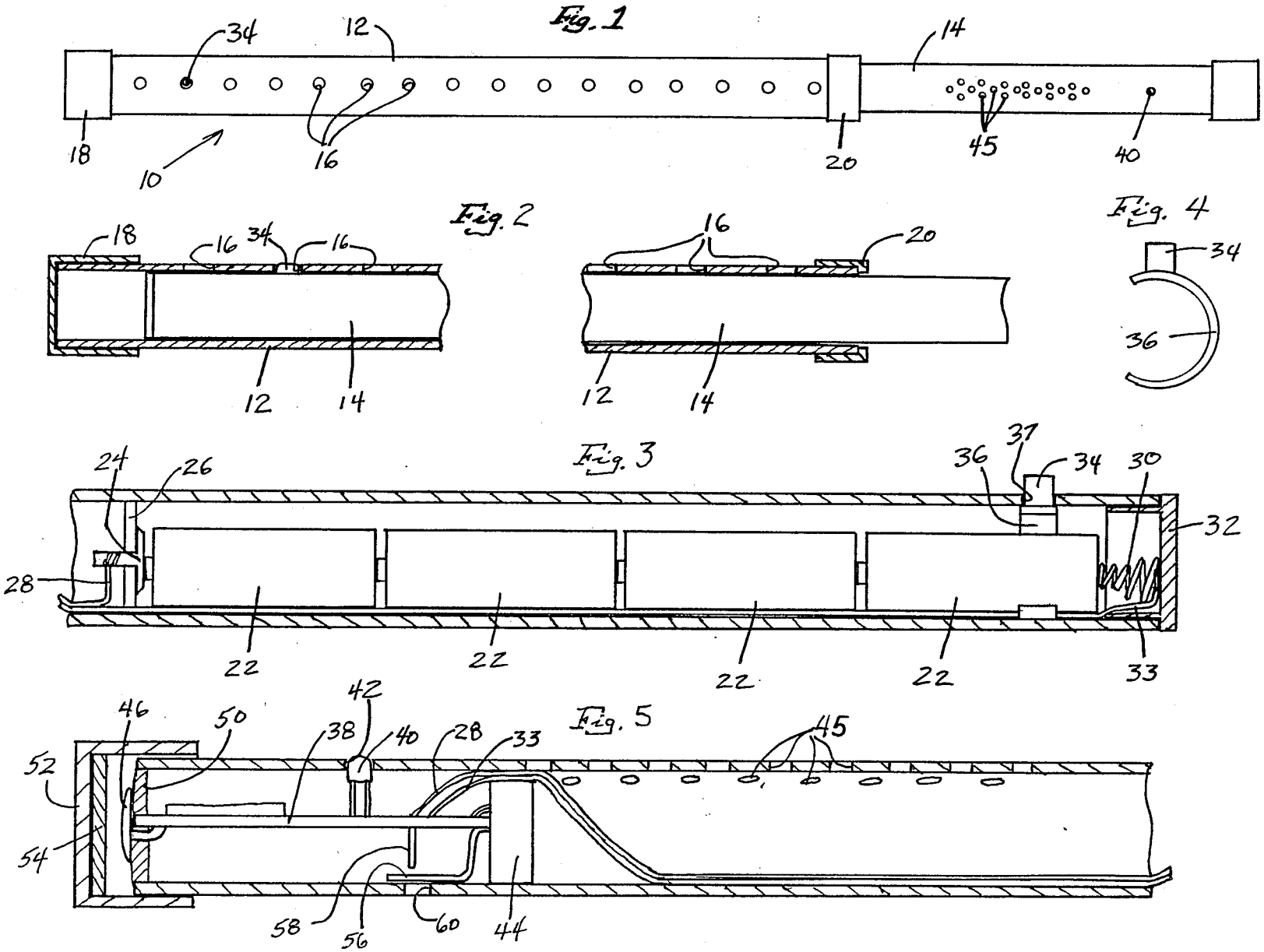
FIG. 1 is a top plan view of the alarm device of the present invention illustrating it in a near-fully collapsed configuration.
FIG. 2 is a partial cutaway view of the outer tube of the alarm device of FIG. 1, showing the outer tube's configuration and the adjustment button which is mounted in the inner tube.
FIG. 3 is a cutaway view of the end of the inner tube of the alarm device of FIG. 1 which fits in the outer tube, showing the installation of the batteries and the adjustment button.
FIG. 4 is a side plan view of the adjustment button used in the alarm device of FIG. 1 showing the spring construction used to make it return to an extended position when pushed.
FIG. 5 is a side cutaway view of the end of the inner tube of the alarm device of FIG. 1 which extends from the outer tube, showing the installation of the circuit board, the activation switch, the reset switch, and the audio transducer.

The preferred embodiment of the present invention is illustrated in FIG. 1, which shows an alarm device 10. The alarm device 10 includes a larger diameter hollow outer tube 12 which fits in a slidable relationship over a first end on a smaller diameter hollow inner tube 14. In the preferred embodiment, the outer tube 12 and the inner tube 14 are made of rigid polyvinyl chloride (PVC) tubing. By way of example, the outer tube 12 may be 1 1/16 inch outer diameter, ⅞ inch inner diameter PVC tubing, and the inner tube 14 may be ¾ inch outer diameter, 11/16 inch inner diameter PVC tubing.

In the preferred embodiment, the alarm device 10 may be built in several different sizes to facilitate use with different size windows and doors. For example, the alarm device 10 may be constructed in four models of different sizes which will fit virtually any residential window or door size. Typical sizes for the four models would be 12 to 15 inch adjustable length, 16 to 23 inch adjustable length, 24 to 39 inch adjustable length, and 36 to 63 inch adjustable length. The alarm device 10 illustrated in FIG. 1 is intended for use with an adjustable length of 24 to 39 inches.

The outer tube 12 has two ends which shall be referred to herein as the first and second ends of the outer tube 12. The outer tube 12 has a plurality of evenly spaced apart apertures 16 located therein along the length thereof. In the preferred embodiment, the apertures 16 are spaced approximately one inch apart, so the alarm device 10 illustrated in FIG. 1 would require 16 of the apertures 16. A plastic end cap 18 is mounted at the first end of the outer tube 12, as shown in FIGS. 1 and 2. A plastic collar 20 is located at the second end of the outer tube 12, which is the end from which the inner tube 14 extends. The plastic end cap 18 and the plastic collar 20 both enhance the aesthetic appearance of the alarm device 10, and also protect windows, doors, and casings from scratches caused by sharp edges on the outer tube 12.

The inner tube 14 thus fits partially inside the outer tube 12, and extends from the second end of the outer tube 12. Referring to FIG. 3, the interior of the end of the inner tube 14 which is located inside the outer tube 12 is shown; for reference, this end of the inner tube 14 shall be referred to herein as the first end of the inner tube 14. The other end of the inner tube 14, which extends from the outer tube 12, shall be referred as the second end of the inner tube 14. A plurality of conventional batteries 22 are installed in the first end of the inner tube 14 to power the alarm device 10.

In the preferred embodiment illustrated, four "AA" or "N" batteries 22 are installed in the inner tube 14 in series. Installed sufficiently far into the first end of the inner tube 14 to allow the batteries 22 to fit therein is a battery contact 24 mounted in a battery retaining wall 26. The battery retaining wall 26 is fixedly mounted to the interior of the inner tube 14, as for example adhesively using hot melt glue applied through a small aperture (not shown) in the inner tube 14. The battery contact 24 is electrically connected to a first power wire 28.

At the other end of the batteries 22 in the inner tube 14, a conductive spring 30 is mounted in a plastic plug 32, as for example adhesively using hot melt glue. A second power wire 33 is electrically connected to the spring 30. The plastic plug 32 fits into the first end of the inner tube 14 in a resistance or friction fit, and acts to retain the batteries 22 in the inner tube 14 in contact with the battery contact 24 on one end of the batteries 22, and in contact with the spring 30 on the other end of the batteries 22

Referring now to FIGS. 3 and 4, an adjustment button 34 mounted onto an arcuate spring segment 36 in installed in the inner tube 14, so that the adjustment button 34 extends outwardly through an aperture 37 in the inner tube 14. The aperture 37 is located near to the first end of the inner tube 14. When the adjustment button 34 is pressed radially inwardly toward the interior of the inner tube 14, the spring segment 36 will flex. When the force urging the adjustment button 34 radially inwardly is released, the spring segment 36 will urge the adjustment button 34 to return radially outwardly to the position in which it is shown in FIG. 3. The spring segment 36 may be made of any spring material, such as, for example, spring steel.

Moving next to FIG. 5, the interior of the second end of the inner tube 14 is illustrated. A circuit board 38 containing the alarm circuit is mounted in the interior of the inner tube 14 at or near the second end of the inner tube 14. The circuit board 38 may be mounted inside the inner tube 14 as for example by hot melt glue. The first and second power wires 28 and 33 are electrically connected to the circuit board 38 to supply power from the batteries 22 (FIG. 3) to the circuit board 38.

Electrically connected to the circuit board 38 is a light emitting diode (LED) 40, which is mounted in an aperture 42 in the inner tube 14 near the second end of the inner tube 14. The LED 40 is installed so as to be readily visible from the exterior of the inner tube 14 when lit. Mounted in the inner tube 14 on the side of the circuit board 38 away from the second end of the inner tube 14 is an audio transducer 44. The audio transducer 44 may be a piezoelectric buzzer or other device which produces a high volume alarm when supplied with an electrical input from the circuit board 38, to which it is electrically connected.

Located in the side of the inner tube 14 on the side of the audio transducer 44 away from the first end of the inner tube 14 are a plurality of apertures 45. The apertures 45 allow the sound from the audio transducer 44 to escape from the interior of the inner tube 14, which acts as a resonant cavity to enhance the sound produced by the audio transducer 44. The apertures 45 may be arranged in a pattern as best shown in FIG. 1, which pattern has been found to improve the resonant qualities of the inner tube 14. In the preferred embodiment, 16 to 19 apertures 45 are used. When an alarm is to be given, the audio transducer 44 will be activated by the circuit board 38 and the LED 40 will be simultaneously lighted by the circuit board 38.

Figure 6:
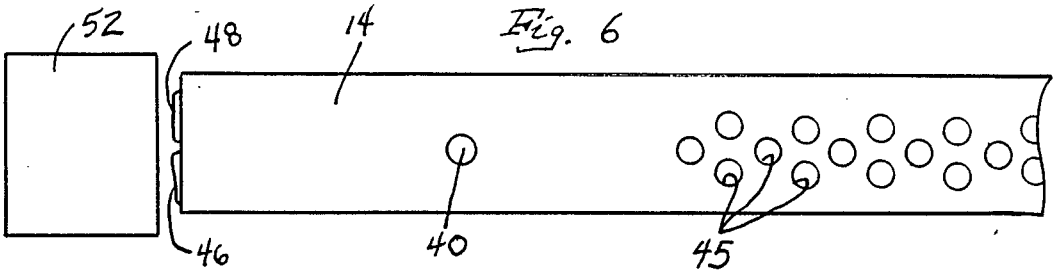
FIG. 6 is a top plan view of the end of the inner tube of the alarm device of FIG. 1 which extends from the outer tube, showing the contacts in the end of the inner tube with the activating end cap removed.

Referring now to FIG. 6 in addition to FIG. 5, the circuit board 38 is also electrically connected to two electrical contacts 46 and 48, which are mounted on an end wall 50 located at the second end of the inner tube 14. When the two electrical contacts 46 and 48 are electrically connected together, the circuit board 38 will cause an alarm to be initiated. A plastic activating end cap 52 is adapted to fit over the second end of the inner tube 14 in a loose fashion allowing the activating end cap 52 to slide on and off of the second end of the inner tube 14.

Installed adhesively or otherwise inside the activating end cap 52 is a conductive element 54, which covers the interior of the end portion of the activating end cap 52. When the activating end cap 52 is pushed fully onto the second end of the inner tube 14, the conductive element 54 will contact both of the two electrical contacts 46 and 48, causing an alarm to be initiated. In the preferred embodiment, the conductive element 54 is a segment of conductive, resilient foam.

It may therefore be appreciated that by installing the activating end cap 52 only partially on the second end of the inner tube 14, the alarm device 10 is primed. When the activating end cap 52 is pushed onto the second end of the inner tube 14, the alarm will be activated. The alarm circuit in the circuit board 38 is designed to keep the alarm sounding once initiated, as will become further evident below. Even if the activating end cap 52 is removed from the second end of the inner tube 14, thus removing the conductive element 54 from the two electrical contacts 46 and 48, the alarm will continue to sound.

Mounted on the bottom of the circuit board 38 is a reset spring contact 56, which is normally biased away from a contact 58, also mounted on the bottom of the circuit board 38. When the alarm is sounded, it may be reset by causing the reset spring contact 56 to make electrical contact with the contact 58 (with the conductive element 54 moved away from the two electrical contacts 46 and 48). The reset spring contact 56 is preferably made of beryllium copper or another material having both good conductive and good spring characteristics. This is accomplished through an aperture 60 located in the bottom of 14, which aperture 60 is aligned with the reset spring contact 56. By inserting a sharp object such as the tip of a pen (not shown) into the aperture 60 and pushing the reset spring contact 56 into contact with the contact 58 (again, with the conductive element 54 moved away from the two electrical contacts 46 and 48), the alarm may be reset.

Figure 7:
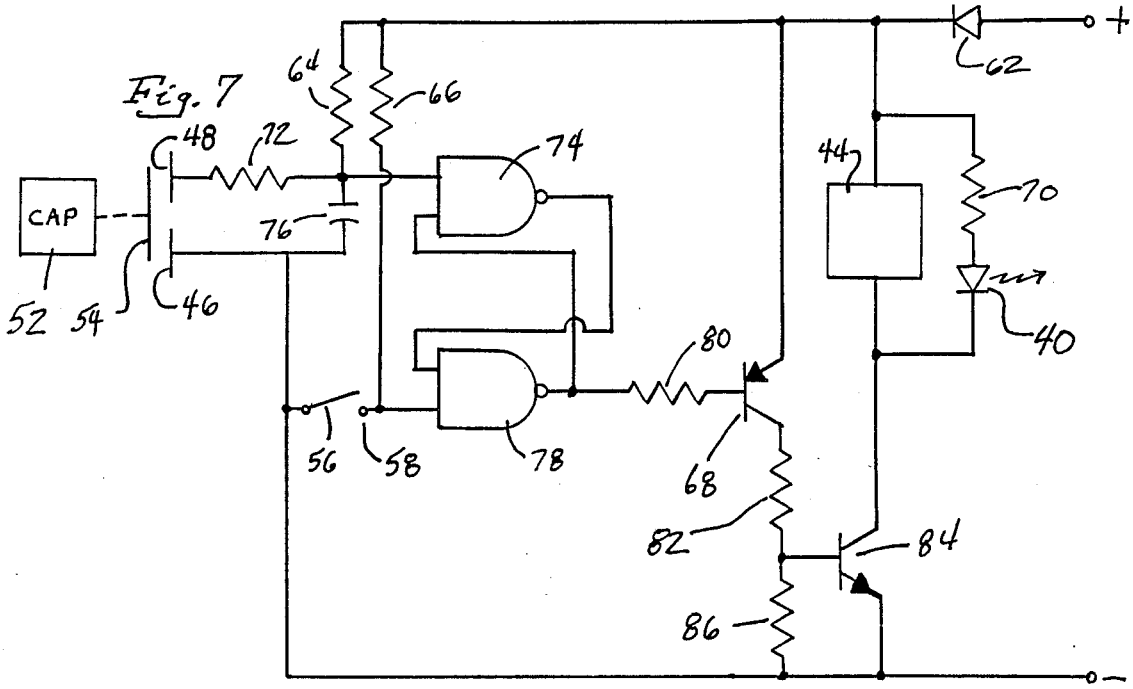
FIG. 7 shows a schematic diagram of a circuit which may be used to operate the alarm device of the present invention.

Referring now to FIG. 7, a circuit which may be used as the alarm circuit and implemented on the circuit board 38 is illustrated. A positive power input is supplied to the circuit through a diode 62, the anode of which is connected to the positive power input. The cathode of the diode 62 is connected to one side of a resistor 64, to one side of a resistor 66, to the emitter of a PNP transistor 68, to one side of the audio transducer 44, and to a resistor 70. The other side of the resistor 64 is connected to one side of a resistor 72, to one input of a two input NAND gate 74, and to one side of a capacitor 76.

The other side of the resistor 72 is connected to the electrical contact 48. The other side of the capacitor 76 is connected to the electrical contact 46, to the reset spring contact 56, and to the negative side of the power supply. The other side of the resistor 66 is connected to one input of a two input NAND gate 78, and to the contact 58. The output of the two input NAND gate 74 is connected as the other input to the two input NAND gate 78. The output of the two input NAND gate 78 is connected as the other input of the two input NAND gate 74, and to one side of a resistor 80.

The other side of the resistor 80 is connected to the base of the PNP transistor 68. The collector of the PNP transistor 68 is connected to one side of a resistor 82. The other side of the resistor 82 is connected to the base of an NPN transistor 84, and to one side of a resistor 86. The other side of the resistor 86 is connected to the negative side of the power supply, as is the emitter of the NPN transistor 84. The collector of the NPN transistor 84 is connected to the other side of the audio transducer 44, and to the cathode of the LED 40. Finally, the anode of the LED 40 is connected to the other side of the resistor 70. In the preferred embodiment, the active components are CMOS components to minimize power requirements and to extend battery operating life.

The operation of the circuit shown in FIG. 7 is as described above. When the activating end cap 52 moves the conductive element 54 into contact with the two electrical contacts 46 and 48, the audio transducer 44 and the LED 40 will be energized. This may be seen as an axial force exerted on the activating end cap 52 at the second end of the inner tube 14 toward the first end of the inner tube 14. Even if the conductive element 54 moves away from the two electrical contacts 46 and 48, the audio transducer 44 and the LED 40 will continue to be energized. When the reset spring contact 56 contacts the contact 58 (with the conductive element 54 not in contact with the two electrical contacts 46 and 48), the circuit will be reset and the audio transducer 44 and the LED 40 will cease to be energized.

Figure 8:
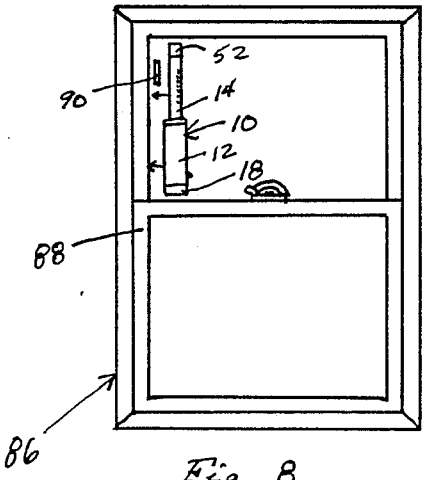
FIG. 8 is a somewhat schematic view of the alarm device of the present invention being installed in a vertically opening and closing window.

Moving now to FIG. 8, the alarm device 10 is being installed in a vertically opening window 86. The alarm device 10 is primed as described above, and then placed in the side track of the window 86 with the moveable window 88 in a closed position. The plastic end cap 18 end of the alarm device 10 will be located against the top edge of the moveable window 88, and the other end of the device will be placed against the top of the window 86 in a manner whereby if the moveable window 88 is opened, the activating end cap 52 will be forced fully onto the end of the inner tube 14. The alarm will thus be actuated. A segment of double-faced tape 90 is used to retain the alarm device 10 in position against the side of the window 86.

Figure 9:
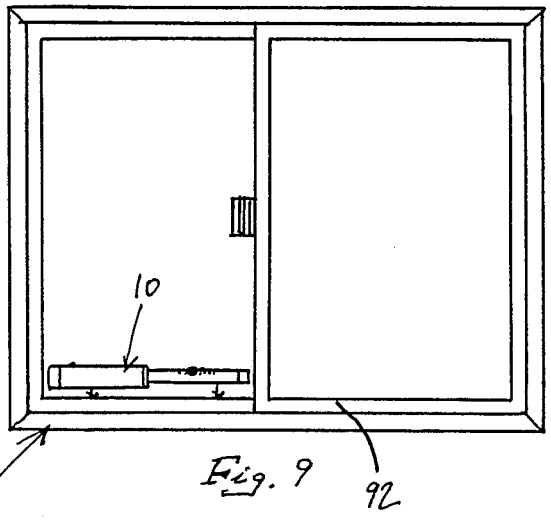
FIG. 9 is a somewhat schematic view of the alarm device of the present invention being installed in a horizontally opening and closing window.

Referring next to FIG. 9, the alarm device 10 is being installed in a horizontally opening window 92. The alarm device 10 is primed as described above, and then placed in the bottom track or sill with the moveable window 92 in a closed position. One end of the device will be located against the edge of the moveable window 92. The other end of the device will be placed against the window casing in a manner whereby if the window or door is opened, the activating end cap 52 will be forced fully onto the end of the inner tube 14, actuating the alarm. In a horizontally opening and closing window or door, either end of the alarm device 10 may be placed in either position, since gravity is not a factor as it is in the above description of installation in a vertically opening and closing window.

From the foregoing detailed description of the preferred embodiment of the present invention, it is apparent that it presents an alarm device which is conveniently useable on sliding doors and windows. The device includes a bar which acts as a physical obstruction preventing opening of a sliding door or window unless and until the device is removed. When a forced entry is attempted, the device sounds an alarm which continues until the device is reset, with the procedure to reset the alarm device being simple, yet not obvious upon initial inspection.

The alarm device of the present invention is widely adjustable to fit in windows or doors of considerably varying widths, and it will work equally well in either vertically opening and closing windows or horizontally opening and closing doors and windows. In addition, the alarm device of the present invention is simple and easy to install without requiring tools for the installation. Installing the device does not damage the door, the window, or the casing in which the door or window is mounted. The device is unobtrusive when installed in the track or sill of a window or door, and as such is neither highly visible nor aesthetically displeasing.

Since the alarm device is collapsible and portable as well as being easy to install without tools, it finds ready application with travelers for use in windows in hotel rooms. It is mechanically simple to ensure reliable operation, and is of solid state construction to ensure both a long, reliable lifetime and energy efficient operation. The alarm device of the present invention is also of inexpensive construction. Finally, the improved alarm of the present invention provides all of the above advantages and objectives without incurring any relative disadvantage.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. An alarm device for use with a sliding door or window mounted in a casing, comprising:

a hollow outer tube having a first end and a second end;

an inner tube having a first end and a second end, said first end of said inner tube being located in said outer tube, said second end of said inner tube extending from said second end of said outer tube;

means for adjusting the length of the portion of said inner tube which protrudes from said second end of said outer tube;

means for receiving one or more batteries in said first end of said inner tube;

electrical switch means for triggering said alarm device, said electrical switch means comprising:

a first electrical contact mounted at said second end of said inner tube;

a second electrical contact also mounted at said second end of said inner tube, said second electrical contact being spaced away from said first electrical contact so as not to be in electrical contact with said first electrical contact;

a plastic activating end cap for installation onto said second end of said inner tube, said activating end cap being adapted to fit over said second end of said inner tube in a loose fashion allowing said activating end cap to slide on and off of said second end of said inner tube, said activating end cap having a first position in which it is partially installed on said second end of said inner tube and a second position in which it is fully installed on said second end of said inner tube; and a conductive element located inside said activating end cap, said conductive element being spaced away from said first and second electrical contacts on said second end of said inner tube and said electrical switch means having an open position when said end cap is in said first position, said conductive material being in contact with said first and second electrical contacts on said second end of said inner tube and said electrical switch means having a closed position when said end cap is moved from said first position to said second position by an axial compressive force between said end cap and said first end of said inner tube; an audio transducer located in said inner tube; and an alarm circuit located in said inner tube, said alarm circuit being electrically connected to said means for receiving batteries, said first and second electrical contacts, and said audio transducer, said alarm circuit causing said audio transducer to emit an alarm signal whenever said electrical switch means has been driven to said closed position.

2. An alarm device as defined in claim 1, wherein said inner and outer tubes are made of rigid polyvinyl chloride (PVC) tubing.

3. An alarm device as defined in claim 1, wherein said inner tube has an outer diameter which is smaller than the inner diameter of said outer tube.

4. An alarm device as defined in claim 1, wherein said adjusting means comprises:

a plurality of evenly spaced apart apertures located in said outer tube along the length thereof;

a spring-loaded detent adjustment button installed in said inner tube with said adjustment button extending outwardly through an aperture in said inner tube, said adjustment button being pressed radially inwardly toward the interior of said inner tube to allow said inner tube to be adjusted axially in said outer tube, said adjustment button being urged radially outwardly and extending through one of said plurality of evenly spaced apart apertures in said outer tube to prevent axial movement of said inner tube with respect to said outer tube.

5. An alarm device as defined in claim 4, wherein said spring-loaded adjustment button is made of spring steel.

6. An alarm device as defined in claim 1, additionally comprising:

a plastic end cap mounted at said first end of said outer tube; and a plastic collar located at said second end of said outer tube.

7. An alarm device as defined in claim 1, additionally comprising:

a battery retaining wall installed sufficiently far into said first end of said inner tube to allow one or more batteries to fit therein;

a battery contact mounted in said battery retaining wall;

a first power wire extending between said battery contact and said alarm circuit;

a conductive spring;

a plastic plug, said conductive spring being mounted in said plastic plug, said plastic plug fitting into said first end of said inner tube in a resistance or friction fit to retain one or more batteries in said inner tube in contact with said battery contact at one end of the one or more batteries, and in contact with said conductive spring at the other end of the one or more batteries; and a second power wire extending between said conductive spring and said alarm circuit.

8. An alarm device as defined in claim 1, additionally comprising:

an end wall installed at said second end of said inner tube, said first and second electrical contacts being mounted in said end wall.

9. An alarm device as defined in claim 1, additionally comprising:

means for causing said alarm circuit to keep said alarm signal sounding once initiated even if said electrical switch returns to said open position.

10. An alarm device as defined in claim 9, additionally comprising:

a reset switch electrically connected to said alarm circuit for causing said alarm circuit to make said alarm signal cease and to reset said alarm device, provided said electrical switch is returned to said open position prior to activating said reset switch.

11. An alarm device as defined in claim 10, wherein said reset switch comprises:

a third electrical contact located inside said inner tube;

a reset spring contact which is normally biased away from said third electrical contact, said reset spring contact also being located inside said inner tube; and an aperture in said inner tube allowing a sharp object inserted into said aperture to contact said reset spring contact and to drive said reset spring contact into electrical contact with said third electrical contact.

12. An alarm device as defined in claim 11, wherein said reset spring contact is made of beryllium copper.

13. An alarm device as defined in claim 1, additionally comprising:

a visual alarm means driven by said alarm circuit for providing a visual indication whenever said alarm circuit causes said audio transducer to emit said alarm signal.

14. An alarm device as defined in claim 13, wherein said visual alarm means comprises:

a light emitting diode (LED).

15. An alarm device as defined in claim 1, additionally comprising:

a plurality of apertures in said inner tube adjacent said audio transducer, said plurality of apertures in said inner tube allowing sound generated by said audio transducer to escape from said inner tube after resonating in said inner tube.

16. An alarm device as defined in claim 15, wherein said apertures in said inner tube are arranged in a pattern to enhance the resonant quality of said inner tube.

17. An alarm device as defined in claim 1, wherein said alarm circuit utilizes at least two NAND gates to implement its function.

18. An alarm device as defined in claim 1, wherein said alarm circuit uses CMOS components to reduce power required to operate said alarm circuit, thereby extending the operating life of batteries used to power said alarm circuit.

19. A method for providing an alarm when a sliding door or window mounted in a casing is opened, comprising:

installing an inner tube having a first end and a second end in a hollow outer tube having a first end and a second end, said second end of said inner tube extending from said second end of said outer tube;

adjusting the length of the portion of said inner tube which protrudes from said second end of said outer tube;

receiving one or more batteries in said first end of said inner tube;

mounting a first electrical contact at said second end of said inner tube;

mounting a second electrical contact at said second end of said inner tube, said second electrical contact being spaced away from said first electrical contact so as not to be in electrical contact with said first electrical contact;

adapting a plastic activating end cap to fit over said second end of said inner tube in a loose fashion allowing said activating end cap to slide on and off of said second end of said inner tube, said activating end cap having a first position in which it is partially installed on said second end of said inner tube and a second position in which it is fully installed on said second end of said inner tube;

installing a conductive element inside said activating end cap, said first and second electrical contacts and said conductive element together defining a switch, said conductive element being spaced away from said first and second electrical contacts on said second end of said inner tube and said electrical switch means having an open position when said end cap is in said first position, said conductive material being in contact with said first and second electrical contacts on said second end of said inner tube and said electrical switch means having a closed position when said end cap is moved from said first position to said second position by an axial compressive force between said end cap and said first end of said inner tube;

installing an audio transducer in said inner tube;

electrically connecting an alarm circuit located in said inner tube to the batteries, to said first and second electrical contacts, and to said audio transducer, said alarm circuit causing said audio transducer to emit an alarm signal whenever said electrical switch means has been driven to said closed position; and installing said alarm device in the casing of the window or door between the edge of the window or door and the casing so that when the window or door is opened said alarm device will be subjected to a compressive axial force tending to drive said electrical switch means at said second end of said inner tube toward said first end of said inner tube.

20. An alarm device for use with a sliding door or window mounted in a casing, comprising:

a hollow outer tube having a first end and a second end;

an inner tube having a first end and a second end, said first end of said inner tube being located in said outer tube, said second end of said inner tube extending from said second end of said outer tube;

means for adjusting the length of the portion of said inner tube which protrudes from said second end of said outer tube;

means for receiving one or more batteries in said first and of said inner tube;

electrical switch means for triggering said alarm device, said electrical switch means being mounted at said second end of said inner tube, said electrical switch means having an open position and a closed position, said electrical switch means being driven from said open position to said closed position when said electrical switch means at said second end of said inner tube is subjected to an axial force directed toward said first end of said inner tube;

an audio transducer located in said inner tube;

an alarm circuit located in said inner tube, said alarm circuit being electrically connected to said electrical switch means and said audio transducer;

a battery retaining wall installed sufficiently far into said first end of said inner tube to allow one or more batteries to fit therein;

a battery contact mounted in said battery retaining wall;

a first power wire extending between said battery contact and said alarm circuit;

a conductive spring;

a plastic plug, said conductive spring being mounted in said plastic plug, said plastic plug fitting into said first end of said inner tube in a resistance or friction fit to retain one or more batteries in said inner tube in contact with said battery contact at one end of the one or more batteries, and in contact with said conductive spring at the other end of the one or more batteries; and a second power wire extending between said conductive spring and said alarm circuit, said alarm circuit causing said audio transducer to emit an alarm signal whenever said electrical switch means has been driven to said closed position.

21. An alarm device as defined in claim 20, wherein said electrical switch means comprises:

a first electrical contact mounted at said second end of said inner tube;

a second electrical contact also mounted at said second end of said inner tube, said second electrical contact being spaced away from said first electrical contact so as not to be in electrical contact with said first electrical contact;

an activating end cap for installation onto said second end of said inner tube, said activating end cap having a first position in which it is partially installed on said second end of said inner tube and a second position in which it is fully installed on said second end of said inner tube; and a conductive element located inside said activating end cap, said conductive element being spaced away from said first and second electrical contacts on said second end of said inner tube when said end cap is in said first position, said conductive material being in contact with said first and second electrical contacts on said second end of said inner tube when said end cap is moved from said first position to said second position.

22. An alarm device as defined in claim 21, wherein said activating end cap is made of plastic and is adapted to fit over said second end of said inner tube in a loose fashion allowing said activating end cap to slide on and off of said second end of said inner tube.

23. An alarm device as defined in claim 21, wherein said conductive element comprises:

a segment of conductive, resilient foam.

24. An alarm device for use with a sliding door or window mounted in a casing, comprising:

a hollow outer tube having a first end and a second end;

an inner tube having a first end and a second end, said first end of said inner tube being located in said outer tube, said second end of said inner tube extending from said second end of said outer tube;

means for adjusting the length of the portion of said inner tube which protrudes from said second end of said outer tube;

means for receiving one or more batteries in said first end of said inner tube;

electrical switch means for triggering said alarm device, said electrical switch means being mounted at said second end of said inner tube, said electrical switch means having an open position and a closed position, said electrical switch means being driven from said open position to said closed position when said electrical switch means at said second end of said inner tube is subjected to an axial force directed toward said first end of said inner tube;

an audio transducer located in said inner tube;

an alarm circuit located in said inner tube, said alarm circuit being electrically connected to said means for receiving batteries, said electrical switch means, and said audio transducer, said alarm circuit causing said audio transducer to emit an alarm signal whenever said electrical switch means has been driven to said closed position; and a plurality of apertures in said inner tube adjacent said audio transducer, said plurality of apertures in said inner tube allowing sound generated by said audio transducer to escape from said inner tube after resonating in said inner tube, wherein there are between 16 and 19 of said apertures in said inner tube.

* * * * *